US008367982B2

(12) United States Patent
Yi et al.

(10) Patent No.: US 8,367,982 B2
(45) Date of Patent: Feb. 5, 2013

(54) BUILT-IN COOKING APPLIANCE AND INSTALLATION APPARATUS FOR THE SAME

(75) Inventors: Soo Cheol Yi, Changwon (KR); Wang Lim Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 604 days.

(21) Appl. No.: 12/448,592

(22) PCT Filed: Nov. 15, 2007

(86) PCT No.: PCT/KR2007/005748

§ 371 (c)(1),
(2), (4) Date: Jan. 5, 2010

(87) PCT Pub. No.: WO2008/082073

PCT Pub. Date: Jul. 10, 2008

(65) Prior Publication Data

US 2010/0108660 A1 May 6, 2010

(30) Foreign Application Priority Data

Dec. 29, 2006 (KR) ..... 10-2006-0138273
Jan. 9, 2007 (KR) ..... 10-2007-0002570

(51) Int. Cl.
*H05B 3/68* (2006.01)

(52) U.S. Cl. ..... 219/452.11; 219/451.1; 219/623; 126/214 A

(58) Field of Classification Search ..... 219/443.1, 219/451.1, 451.11, 451.12, 620, 622, 623, 219/452.11, 45.12; 126/1 R, 15 R, 15 A, 126/214 A, 299 D
See application file for complete search history.

(56) References Cited

U.S. PATENT DOCUMENTS

| | | | | |
|---|---|---|---|---|
| 3,541,945 | A * | 11/1970 | Wexler | 454/359 |
| 4,363,956 | A * | 12/1982 | Scheidler et al. | 219/452.12 |
| 4,665,893 | A * | 5/1987 | Miyagawa et al. | 126/299 D |
| 4,899,028 | A * | 2/1990 | Arai et al. | 219/623 |
| 5,446,268 | A * | 8/1995 | Chen | 219/623 |
| 6,043,462 | A * | 3/2000 | Stedron et al. | 219/452.11 |
| 6,067,980 | A * | 5/2000 | Kahlke et al. | 126/214 R |
| 6,236,024 | B1 * | 5/2001 | Gotz et al. | 219/452.11 |

FOREIGN PATENT DOCUMENTS

| | | |
|---|---|---|
| DE | 19610428 | 9/1997 |
| JP | 3122990 | 5/1991 |
| JP | 04-110543 | 4/1992 |

(Continued)

*Primary Examiner* — Fernando L Toledo
*Assistant Examiner* — Bryan Junge
(74) *Attorney, Agent, or Firm* — McKenna Long & Aldridge LLP

(57) ABSTRACT

Provided is a built-in cooking appliance. According to the built-in cooking appliance, the inside of the cooking appliance is effectively cooled and the inside can be waterproofed without protruding the top plate above the cabinet. Therefore, cooling efficiency, stability in using, convenience in cleaning, esthetic feeling, and reliability of a product can be improved. The built-in cooking appliance includes a top plate, a main body below the top plate, a fan, a cabinet, a gap portion, and a top frame. At least a heating unit is disposed inside the main body. The fan forms a cooling passage inside the main body. The plate is installed on the cabinet. The gap portion defines at least a portion of the cooling passage, and is formed by at least an edge on one side of the top plate and the cabinet separated from each other. The top frame covers the gap portion.

20 Claims, 5 Drawing Sheets

FOREIGN PATENT DOCUMENTS

| | | | |
|---|---|---|---|
| JP | H4-110543 | U | 9/1992 |
| JP | 5-121155 | A | 5/1993 |
| JP | 2690156 | B2 | 12/1997 |
| JP | 10-185211 | A | 7/1998 |
| JP | 11-354263 | A | 12/1999 |
| JP | 2000-220846 | A | 8/2000 |
| JP | 2004-53239 | A | 2/2004 |
| JP | 2006-59740 | A | 3/2006 |
| JP | 2006-343071 | A | 12/2006 |
| KR | 10-2002-0045380 | A | 6/2002 |
| RU | 2 303 748 | C2 | 7/2007 |
| WO | WO 2005/088199 | A1 | 9/2005 |

* cited by examiner

BUILT-IN COOKING APPLIANCE AND INSTALLATION APPARATUS FOR THE SAME

This application claims the benefit of PCT/KR2007/005748 filed on Nov. 15, 2007, and Korean Patent Application Nos. 10-2006-0138273 and 10-2007-0002570 filed on Dec. 29, 2006 and Jan. 9, 2007 respectively, the contents of which are hereby incorporated herein by reference for all purposes in their entirety.

TECHNICAL FIELD

The present disclosure relates to a built-in cooking appliance and an installation apparatus thereof, and more particularly, to a cooking appliance having a high temperature top plate to cook food.

BACKGROUND ART

A built-in cooking appliance is a kitchen appliance directly installed on a cabinet. That is, the built-in cooking appliance is installed when a furniture such as a cabinet is installed in the kitchen, so that a user can conveniently use the same. The built-in cooking appliance makes the interior of the kitchen beautiful.

In recent years, a built-in cooking appliance having a top plate, which can cook the food using heat transmitted to the food through the top plate, has been developed. Such a built-in cooking appliance having the top plate is called a hot plate, a hob, a range, or a cook-top. Regardless of the name, a concept of the present invention may be applied to any cooking appliances having the top plate. In the following description, a terminology "cooking appliance" means a cooker having the top plate.

In a related art cooking appliance, air is allowed to flow in and out of the cooking appliance so that inner parts of the cooking appliance may operate in a thermal stable state. For this purpose, the top plate protrudes from the upper surface of the cabinet to a considerably height or more. Accordingly, a portion around the top plate is difficult to clean, and an appearance is not elegant.

Also, in a related art cooking appliance, water may flow into a main body of the cooking appliance through an air passage hose formed in a top plate or a portion around the top plate. The water flowing into the main body of the cooking appliance may cause a short circuit or malfunction of the cooking appliance. This limitation must be considered in designing the cooking appliance as the cooking appliance is used in the kitchen that is in a most wet environment.

DISCLOSURE OF INVENTION

Technical Problem

Embodiments provide a built-in cooking appliance that can swiftly cool an inside of the cooking appliance even without protruding a top plate above a cabinet, and an installation apparatus thereof.

Embodiments also provide a built-in cooking appliance that allows a user to safely use the built-in cooking appliance, and an installation apparatus thereof.

Technical Solution

In one embodiment, a built-in cooking appliance includes: a top plate; a main body below the top plate, inside which at least a heating unit is disposed; a fan forming a cooling passage inside the main body; a cabinet on which the top plate is installed; a gap portion defining at least a portion of the cooling passage, the gap portion being formed by at least an edge on one side of the top plate and the cabinet separated from each other; and a top frame covering the gap portion.

In another embodiment, an installation apparatus of a built-in cooking appliance includes: a top plate; a main body below the top plate, on which a plurality of parts are mounted; a cabinet providing a space receiving the main body; a top frame between the top plate and the cabinet; an air outlet at the top frame, the air outlet allowing fluid inside the main body to be discharged outside the cabinet; and an air outlet cover opening/closing the air outlet.

In further another embodiment, a built-in cooking appliance includes: a top plate; a main body below the top plate, inside which at least a heating unit is disposed; a cabinet on which the top plate is installed; a support supporting the top plate against the cabinet; and a top frame covering at least one edge of the top plate, an upper surface of the top plate being disposed at a position lower than that of an upper surface of the cabinet.

In still further another embodiment, an installation apparatus of a built-in cooking appliance includes: a top plate; a main body below the top plate, inside which at least a heating unit is disposed; a fan forming a cooling passage inside the main body; a cabinet on which the top plate is installed; a gap portion defining at least a portion of the cooling passage, the gap portion being formed by at least an edge on one side of the top plate and the cabinet separated from each other; a top frame covering the gap portion; and an air outlet in the top frame to discharge air to an outside.

ADVANTAGEOUS EFFECTS

According to an embodiment, cooling efficiency of a built-in cooking appliance, stability in using, convenience in cleaning, esthetic feeling, and high reliability of a product can be obtained.

BEST MODE FOR CARRYING OUT THE INVENTION

Reference will now be made in detail to the embodiments of the present disclosure, examples of which are illustrated in the accompanying drawings.

First Embodiment

Figure 1:
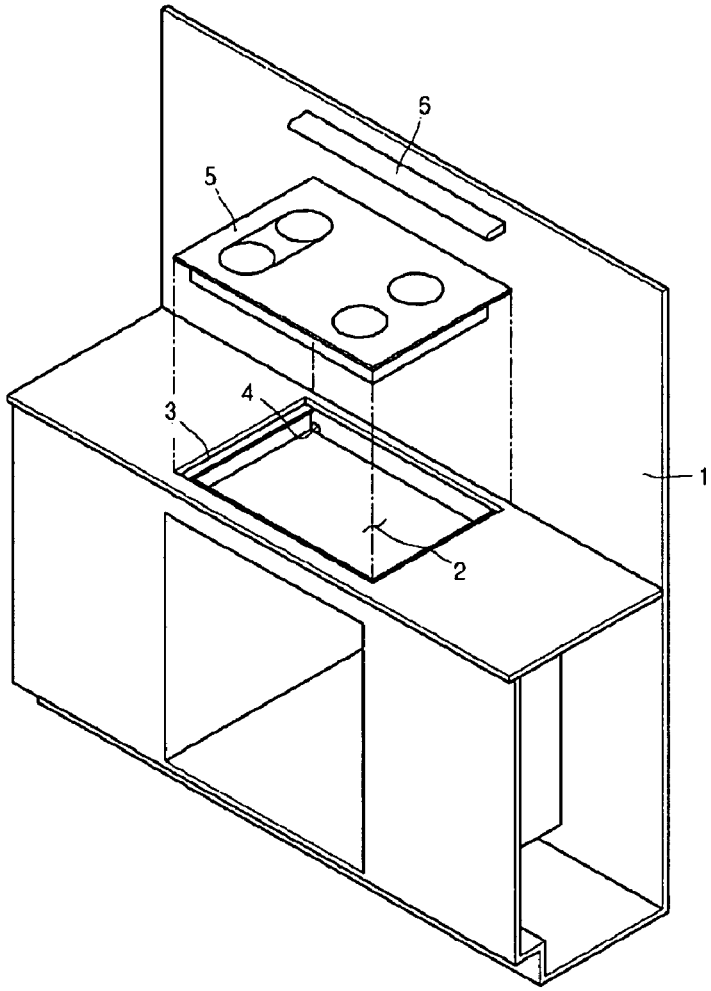
FIG. 1 is a perspective view illustrating a built-in cooking appliance installed according to an embodiment.

FIG. 1 is a perspective view illustrating a built-in cooking appliance installed according to an embodiment.

Referring to FIG. 1, the built-in cooking appliance includes a cabinet 1, a depressed portion 2 recessed downward from one side of the cabinet 1 to provide a space on which a cooking appliance is disposed, a seat portion 3 recessed downward from the edges of the depressed portion 2 and provided to have a height difference, a cooking appliance 5 seated on the seat portion 3, a water outlet 4 formed by opening one side of the depressed portion 2, and a top frame 6 covering a portion separated between the cooking appliance 5 and the cabinet 1 at the upper side.

Figure 3:
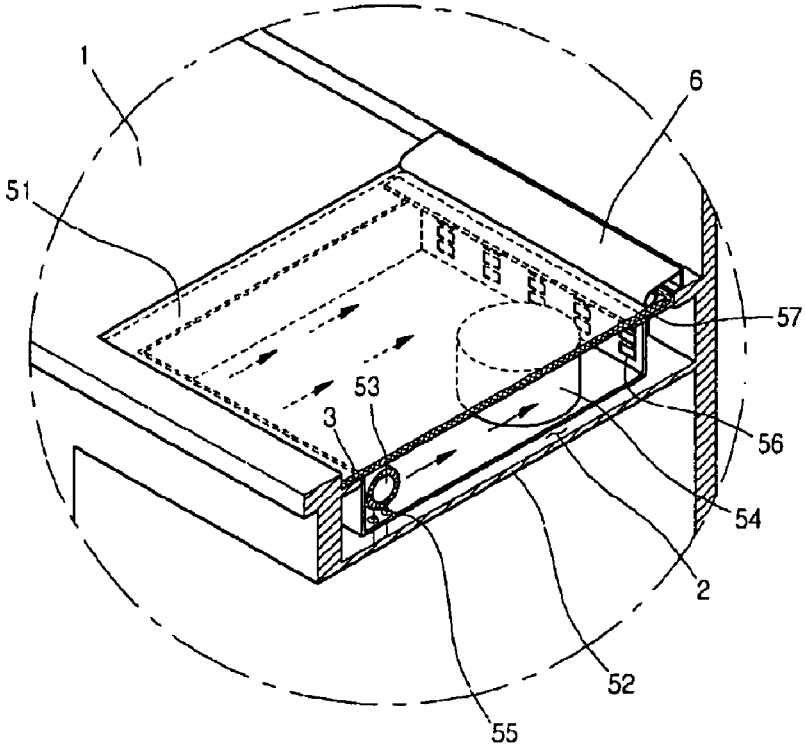
FIG. 3 is a cut perspective view of a built-in cooking appliance according to an embodiment.

The seat portion 3 is a portion recessed downward by a predetermined distance from the edges of the depressed portion 2. The seat portion 3 supports the edges of the cooking appliance 5. In detail, the seat portion 3 supports a high temperature top plate 51 of FIG. 3 provided to the upper end of the cooking appliance 5. Also, a depth by which the seat portion 3 is recessed downward is greater than the thickness of the top plate 51. Therefore, the upper surface of the top plate 51 is disposed lower than the upper surface of the cabinet 1. The seat portion 3 is formed along portions on which the front edge and both lateral edges of the cooking appliance 5 are seated, and not formed on the rear edge of the cooking appliance 5. This configuration is for providing a gap portion through which inside heat of the cooking appliance 5 is discharged to the rear edge of the cooking appliance 5.

When the top plate 51 is disposed lower than the cabinet 1 as described above, a dish disposed on the top plate 51 is caught by the cabinet 1 at the edges of the top plate 51 when it moves, so that the dish does not fall down to the outside of the top plate 51. Therefore, user safety improves. Moreover, whether the dish is properly disposed inside the top plate 51 when it is disposed on the top plate 51 can be clearly recognized using a slope state of the dish, so that heating efficiency of the cooking appliance improves, and user convenience improves.

Figure 2:
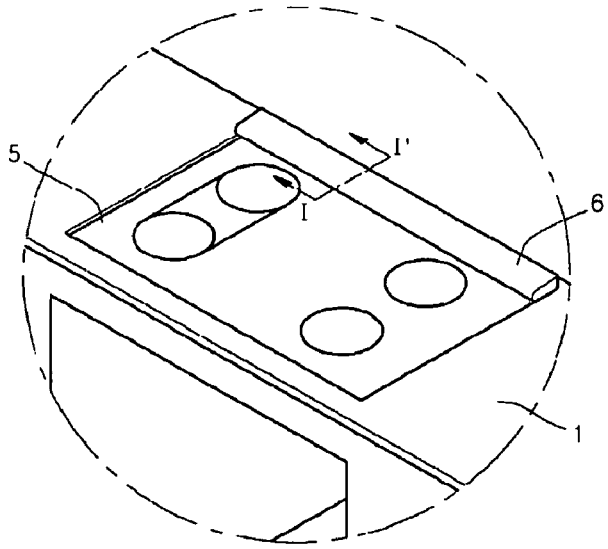
FIG. 2 is a perspective view illustrating a cooking appliance installed according to an embodiment.

Referring to a perspective view of an installation state of a cooking appliance illustrated in FIG. 2, the relative position structure and state between the cooking appliance 5 and the cabinet 1 can be easily understood.

The lower side of the depressed portion 2 is closed. Though it is closed, outside air can be introduced into the depressed portion 2 through gaps of the cabinet 1, and the introduced air can flow into the cooking appliance. Also, the water outlet may be provided right below a path through which water flows downward from the cooking appliance 5. In the case where the bottom of the depressed portion 2 is provided in a slope shape, the water outlet can be formed in a lowest point of the sloped bottom.

The top frame 6 is installed at a portion to which inside heat of the cooking appliance 5 is discharged, that is, the portion covering a gap portion open between the top plate 51 and the cabinet 1. The top frame 6 extends up to the top plate 51 and the upper surface of the cabinet 1 to cover the gap portion between the top plate 51 and the cabinet 1.

Also, since the top frame 6 and the top plate 51 are separated from each other by a predetermined distance, air or water can flow through the separated distance. Also, an opening is formed in the top frame 6 so that air can flow. Since the top frame 6 provides two paths through which air or water can flow, swift flowing of fluid can be induced.

Figure 4:
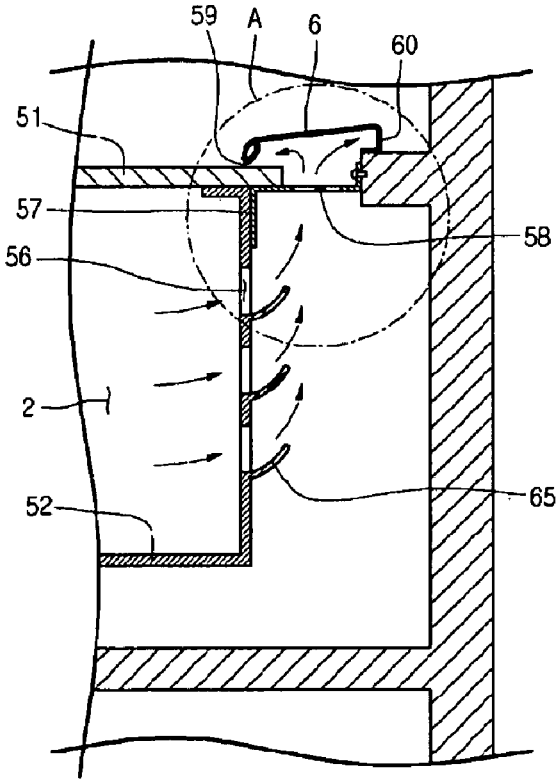
FIG. 4 is a cross-sectional view of a built-in cooking appliance, taken along the line I-I' of FIG. 2 according to an embodiment.

FIG. 3 is a cut perspective view of a built-in cooking appliance according to an embodiment, and FIG. 4 is a cross-sectional view of a built-in cooking appliance, taken along the line I-I' of FIG. 2 according to an embodiment.

Referring to FIGS. 3 and 4, the cooking appliance 5 includes a top plate 51 reserving as a support plate on which a dish is disposed, and a main body 52 disposed under the top plate 51. Also, a heater 54 applying at least heat, and a fan 53 discharging inside heat of the main body 52 to the outside are provided inside the main body 52. Any heater such as a direct heating type heater and an inductive heating type heater can be used as the heater 54.

Also, the top plate 51 is seated on a seat portion 3, and the seat portion 3 is recessed up to a position recessed by a predetermined depth from the upper end of the cabinet 1, so that the upper surface of the top plate 51 has a height lower than that of the upper surface of the cabinet 1.

Also, a gap portion between the rear end of the top plate 51 and the cabinet 1 is covered with a top frame 6.

In detail, at least a portion of the top frame 6 is fixed at the cabinet 1. Coupling between the top frame 6 and the cabinet 1 can be performed using various methods such as adhesion, screw fixing, and hooker fixing. Preferably, the screw fixing is used. A rear opening 60 is formed in the rear end of the top frame 6, so that warm air inside the cooking appliance 5 can be discharged to the outside through the rear opening 60. Also, a predetermined gap is formed between the front portion of the top frame 6 and the upper end of the top plate 51, and the gap serves as a front opening 59 to discharge warm air inside the cooking appliance 5 to the outside. The sizes of the rear opening 60 and the front opening 59 can change depending on the specification and the heat emission amount of the cooking appliance 5. Since at least two discharge passages are formed by the top frame 6, flowing resistance of air discharged from the cooking appliance 5 reduces.

A structure where the weight of the cooking appliance 5 is supported by the cabinet 1 is described.

First, three sides of the front side and both sides of the cooking appliance 5 are supported with the top plate 51 disposed on the seat portion 3 of the cabinet 1. Also, the rear side of the cooking appliance 5 is supported while a separate support 57 is fixed to the bottom of the top plate 51 and the cabinet 1. The bottom of the top plate 51 and the support 57 can be fixed to each other using an adhesion method or a screw fixing method. The cabinet 1 and the support 57 can be fixed to each other using a screw inserting method. Also, an upper end of a frame forming the main body 52 is bent and extends in an extension direction of the top plate 51, so that the bent portion can be bonded and fixed to the lower surface of the main body 52.

A flowing process of air cooling the inside of the cooking appliance 5 is described.

First, when the fan 53 operates, cool air is introduced into the cooking appliance. The introduced air by the fan 53 can be sucked through an introducing hole 55 formed in the lower surface of the main body 52 aligned with the fan 53. The air introduced through the introduction hole 55 can be sucked through a gap of the cabinet 1 formed at the front portion of the depressed portion 2. Of course, in the case where the bottom of the depressed portion 2 is formed to be open, the air may be sucked on the whole through the bottom of the depressed portion 2.

Air discharged through the fan 53 passes through a controller (not shown) of the cooking appliance and the heater 54, and then is discharged through an air hole 56 formed in the rear of the main body 52.

The air discharged through the air hole 56 is introduced to the inner space of the top frame 6 through a support through hole 58. Separate flowing guides 65 can be further formed on the rear side of the main body 1 to allow the air discharged through the air hole 56 to flow to the support through hole 58, not other space inside the depressed portion 2. Though the flowing guides 65 are provided for a plurality of air holes 56, respectively according to an embodiment, they are not limited thereto but one large flowing guide 65 can be provided in a shape extending from the lower side of the main body 52 to the support through hole 58.

Warm air introduced to the inner space of the top frame 6 can be discharged to the outside while flowing to the front or the rear through a front opening 59 formed in the front of the top frame 6 or a rear opening 60 formed in the rear of the top frame 6.

Since the air discharged from the inside of the top frame 6 to the outside is divided to two parts of the front and the rear, the flowing efficiency of the discharged air increases, flowing resistance reduces, and a noise reduces.

Furthermore, the air discharged through the front opening 59 can rapidly cool high temperature heat of the upper surface of the top plate 51 while flowing along the upper surface of the top plate 51. Therefore, residual heat remaining at the top plate 51 after use of the cooking appliance 5 is completed can be rapidly cooled, and a user can use the cooking appliance more safely.

Of course, when the cooking appliance operates with a dish disposed, air discharged through the front opening 59 may destroy heat delivered from the top plate 51 to the dish. However, even in this case, since the top plate 51 closely contacts the dish, and air is not introduced through a contact surface, reduction in heat efficiency is not very much. Furthermore, an optimum size ratio is obtained by controlling a size ratio of the front opening 59 to the rear opening 60, so that a proper size that can secure user safety without reduction in heat efficiency can be obtained.

The rear opening 60 allows high temperature air to be discharged to the rear.

User satisfaction for a built-in cooking appliance can be increased and the cooking appliance can be used more conveniently by making the front opening 59 and the rear opening 60 in their entirety invisible to the natural eyes of the user. In other words, the front opening 59 appears absent when seen from the outside because the upper surface of the top plate 51 touches the top frame 6, but actually, the top plate 51 and the top frame 6 are floated with respect to each other and separated from each other to provide the front opening 59.

Fluid at an adjacent portion of the cooking appliance is described according to an embodiment.

First, since the cooking appliance is installed in a place where water is frequency used, water introduced from the outside should not be introduced into the main body of the cooking appliance. For this purpose, the lower surface of the top plate 51 and contact surfaces of the seat portion 3 are sealed with a predetermined sealing material along the front and both lateral sides of the top plate 51. Therefore, only a portion of the top frame 6 disposed at the rear of the top plate 51 is problematic when fluid flows from the outside. In detail, the front opening 59 formed in the front of the top frame 6, and the rear opening 60 formed in the rear of the top frame 6 are the problematic portions.

First, water flowing from above the top plate 51 can be introduced inside the main body through the front opening 59. The water introduced through the front opening 59 can flow downward through the support through hole 58, and the flowed water can be discharged to the outside through a water outlet 4, or evaporated by heat of the cooking appliance itself. Also, since the rear opening 60 is located in a place higher than the cabinet 1 by a predetermined level, water introduced through the rear opening 60 is basically blocked by the top frame 6. Also, excessive water introduced beyond the rear opening 60 flows downward through the support hole 58 and is discharged through the water outlet 4.

Here, the support hole 58 may be located in the rear by a predetermined level in comparison with a flowing guide 65 so that water introduced through the support through hole 58 does not flow into the main body 52.

Furthermore, a skirt having a predetermined length and extending downward can be formed at the front end of the support through hole 58 so that the water that has flowed down through the support through hole 58 swiftly flows downward to the water outlet. In this case, since the water flows downward along the skirt, it is possible to basically remove a possibility that water flows into the main body.

Figure 5:
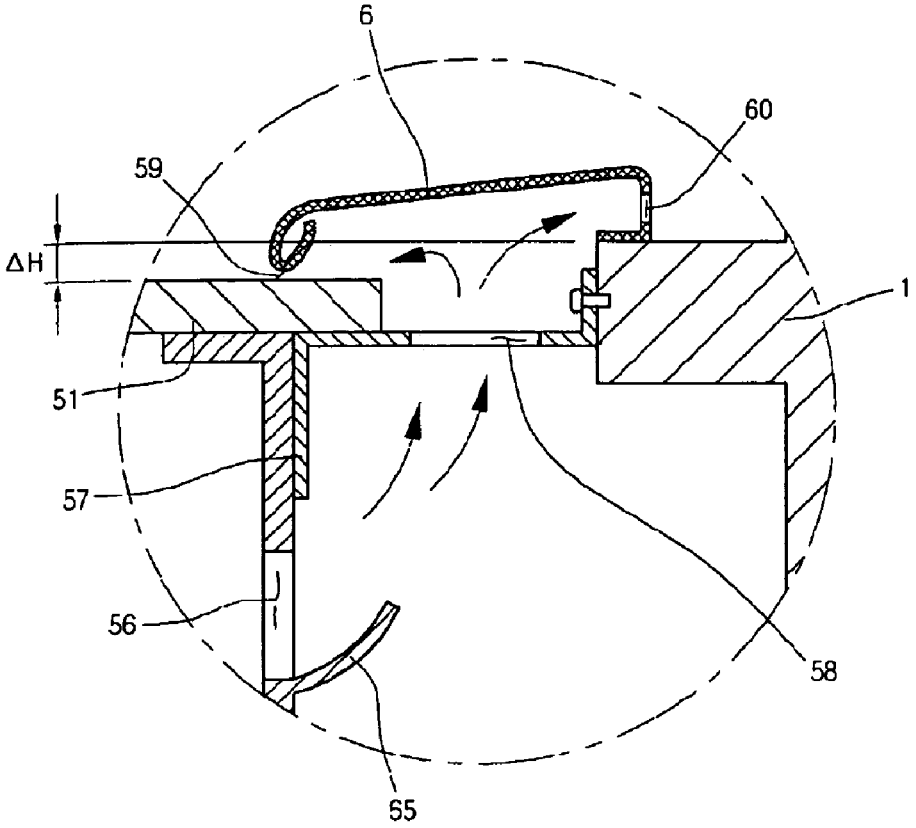
FIG. 5 is an enlarged view of a portion A of FIG. 4.

FIG. 5 is an enlarged view of the portion A of FIG. 4.

Referring to FIG. 5, the upper surface of the cabinet 1 is located at a position higher by a predetermined height $\Delta H$ than the upper surface of the top plate 51. Therefore, when a dish is disposed on the top plate 51, stability in selecting the position of the dish increases. Furthermore, since the cooking appliance is disposed to a lower position, esthetic feeling felt by a user improves.

Also, warm air inside the cooking appliance is divided and discharged to the front and the rear of the top frame 6, so that resistance against airflow can be reduced.

Also, since air discharged through the front opening can be used to cool the top plate, a fan is rotated in high speed after cooking is completed to rapidly cool the top plate, so that user safety is enhanced. For this purpose, the front opening and the rear opening can be selectively closed by a predetermined shield layer. For example, while the cooking appliance is in operation, only the rear opening can be opened to allow warm air to be discharged to only the rear of the top frame 6. In the case where an operation of the cooking appliance is completed and the top plate should be cooled, only the front opening can be opened to rapidly cool the top plate even more.

An embodiment further includes a modified example described below.

First, though the seat portion 3 is formed by recessing the cabinet itself in a successive configuration in the above description, it is not limited thereto but a separate element can be coupled to the cabinet 1, or a plurality of installation elements can be fixed to the cabinet 1 with a predetermined interval.

The water outlet 4 allows water formed on the lower surface of the depressed portion 2 to be collected and drained to the outside when the lower surface of the depressed portion 2 is closed. For another case, in the case where the lower surface of the depressed portion 2 is not closed but open, a predetermined water collecting device can be provided at a predetermined position of the lower portion of the depressed portion 2 to collect water flowing down from the above and discharge the water to the outside.

Also, according to the above embodiments, the top frame is disposed on the rear side of the top plate. However, the installation of the top plate is not limited thereto but the top plate can be formed on the side or both sides or the front or both sides facing each other of the top plate. Furthermore, though the top frame is provided as a structure covering a gap portion between the cooking appliance and the cabinet through which high temperature air flowing through the cooking appliance is discharged according to the above embodiment, the top frame is not limited thereto but can be provided in any form having only a decorative function covering the gap portion between the top plate and the cabinet regardless of airflow. In this case, the top frame can be provided in the form covering the upper surface of the top plate on the whole.

Though the support 57 is bonded on the bottom of the top plate and the main body 52 and the support 57 are fixed using an adhesive method according to the embodiment, they are not limited thereto but can be coupled and fixed using screws. For another case, in the case where the weight of the cooking appliance 5 is sufficiently supported when the upper surface of the top plate 51 is seated on the seat portion 3, the support 57 may not be needed separately. It is natural that a support through hole through which air or fluid can pass should be formed in the support 57 in the case where the support 57 is provided.

Also, supports 57 can be installed on four sides of the main body, or can be installed along the main body and the cabinet on the whole. In this case, an installation process is complicated and thus not preferably, but the seat portion 3 does not need to be formed on the cabinet 1, so that the cabinet is easy to manufacture and a processing is easy.

Also, though the support 57 is provided as a separate element independently of a case of the main body 52 according to the embodiment, the support 57 is not limited thereto. For example, the main body 52 can be made to realize the function of the support 57 together by making the upper bent surface of the case of the main body 52 face the outside to allow a portion of the case to be bonded on the lower surface of the top plate, and an end of the portion extending to the outside to be fixed to the cabinet 1 using a screw.

Also, though warm air is discharged to only the rear through the rear opening according to the embodiment, the rear opening is not limited thereto but a hole can be provided in the upper surface of the top frame to allow air to flow to the upper surface, or the shape of the top frame can be modified to discharge air in a direction inclined upward by a predetermined angle while the air faces the rear.

Also, though, regarding the front opening, air or fluid flows through a gap between the front lower end of the top frame and the top plate, but the configuration is not limited thereto. For example, just like the rear opening is formed, the top frame is manufactured such that the front opening is floated by a predetermined height at the front of the top frame, so that flowing water along the top plate can be caught by a blocking layer and air can flow. For another case, in the case where the top frame is supported by the top plate, it is readily expected that the rear opening be formed in a gap portion between the top frame and the cabinet.

Also, though the front opening and the rear opening are open on the whole according to the embodiment, they are not limited thereto but can be provided in a configuration where a plurality of openings are separated from one another and open.

The above embodiments allow warm air inside the cabinet to be swiftly discharged. Also, water pouring in at a time from the outside is not introduced into the inside of the cooking appliance but drained to a lower space.

Hereinafter, an embodiment for swiftly discharging inside heat of the cooking appliance to the outside while reinforcing a function of allowing water from the outside not to be basically introduced into the cooking appliance is proposed. Descriptions of the same portions as those of the previous embodiment are omitted.

Second Embodiment

Figure 6:
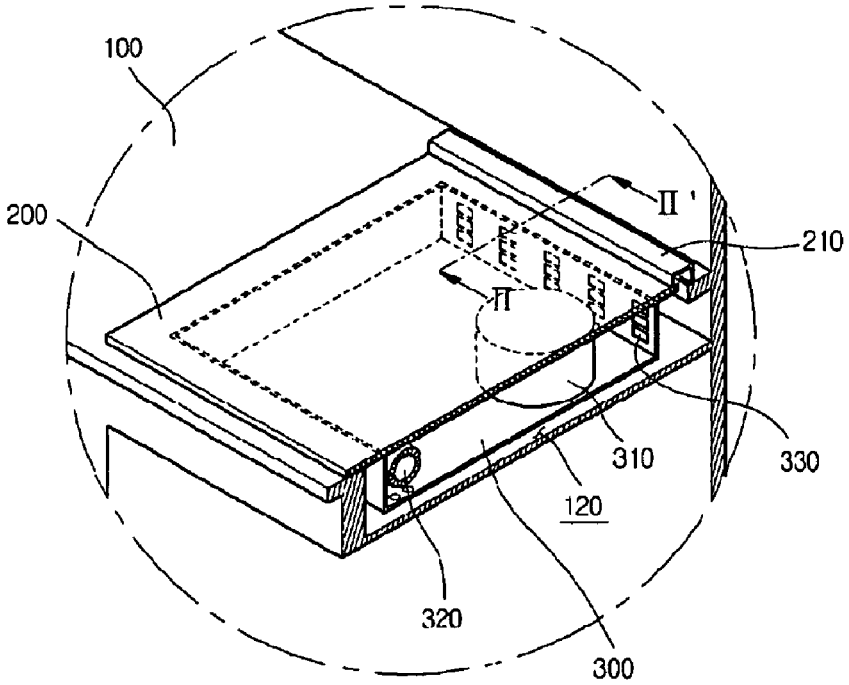
FIG. 6 is a partially cut perspective view of a built-in cooking appliance according to another embodiment.
Figure 7:
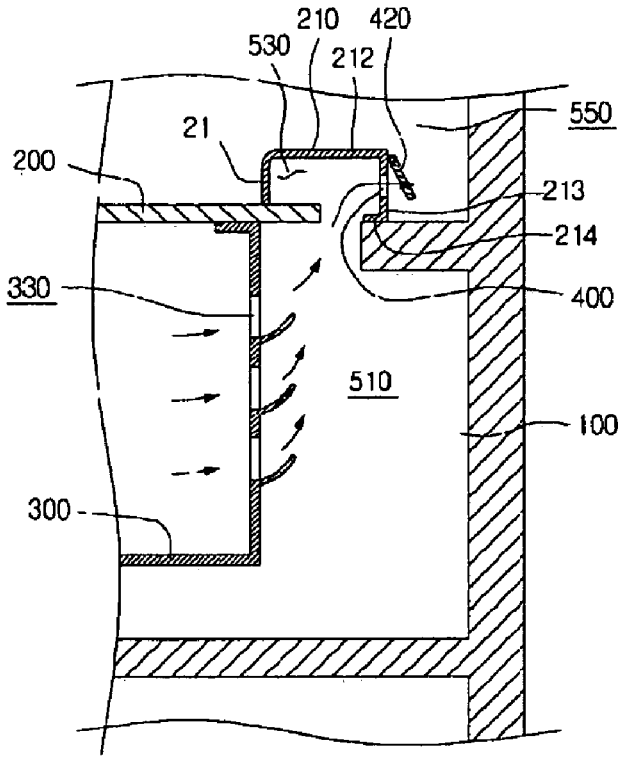
FIG. 7 is a cross-sectional view taken along the line II-II' of FIG. 6.

FIG. 6 is a partially cut perspective view of a built-in cooking appliance according to another embodiment, and FIG. 7 is a cross-sectional view taken along the line of FIG. 6.

Referring to FIGS. 6 and 7, a top plate 200 directly/indirectly supporting a case containing food while forming an upper appearance is provided to the upper end of the cooking appliance. An inner space is formed under the top plate 200 to receive a main body 300 on which a plurality of parts are mounted. The top plate 200 and the main body 300 form an appearance of a cooking appliance.

The top plate 200 is formed in a quadrangular plate having a predetermined thickness using heat tempered glass made of ceramic material to have a property strong against heat. The top plate is for enduring heat generated from a heat source mounted in the inner space of the main body 300 and cooking food.

The top plate 200 is supported by a seat, which is a portion formed by recessing the edges of a receiving portion 120, or by the upper surface of a cabinet 100. In the embodiment, the lower surface of the top plate 200 is supported by the cabinet 100, so that the lower surface of the top plate 200 and the upper surface of the cabinet 100 form substantially the same plane.

A top frame 210 is mounted between the edges of the top plate 200 and the upper surface of the cabinet 100. The top frame 210 shields the upper end between the edges of the top plate 200 and the upper surface of the cabinet 100. At this point, the top frame 210 is mounted to discriminate the upper surface of the top plate 200 and the upper surface of the cabinet 100 when a predetermined interval is formed or is not formed between the edges of the top plate 200 and the upper surface of the top plate 200.

The top frame 210 includes a portion located along the upper edge of the top plate 200, and another portion located along the edges of the cabinet 100. The top frame 210 can be fixed on the upper surface of the top plate 200 using various methods such as adhesion and hooker fixing. Preferably, they are fixed to each other through adhesion.

The top frame 210 prevents a case containing food on the top plate 200 from falling to the outside of the top plate 200 when the case moves due to humidity. Therefore, user safety improves. Furthermore, since whether the case is properly disposed inside the top plate 200 can be clearly recognized when the case is put on the top plate 200, heating efficiency of the cooking appliance improves, and user convenience improves.

Also, the top frame 210 is installed also at a portion through which inside air of the cooking appliance is discharged, that is, between the rear of the top plate 200 and the cabinet 100. At this point, the main body 300 and the cabinet 100 are mounted such that they are separated from each other below the top frame 210 installed between the rear of the top plate 200 and the cabinet 100. This separation allows air or water to flow. Also, an air outlet of a predetermined size is formed in the top frame 210 to allow fluid to flow. The top frame 210 provides a passage through which fluid can flow, so that fluid can swiftly flow.

In the above embodiment, the lower surface of the top plate 200 is so located as to form substantially the same plane as the upper surface of the cabinet 100. When the lower surface of the top plate 200 forms substantially the same plane as the upper surface of the cabinet 100, a user cannot feel much difference with respect to the appearance of the cooking appliance, so that dissatisfaction about the appearance of the cooking appliance is resolved.

The upper surface of the cabinet 100 and the upper surface of the cooking appliance make a difference by the thickness of the top plate 200, but the top frame 210 shields the edges of the top plate 200, so that the user does not feel much difference. Also, the top plate 200 is not formed thick, so that a difference between the upper surface of the cabinet 100 and the upper surface of the cooking appliance is trivial, so that the user almost does not feel the difference. Therefore, dissatisfaction with respect to the appearance of the cooking appliance can be resolved.

At least one heater 310 serving as a heat source cooking food, and a fan 320 forcibly exhausting heat from the inner space of the main body 300 to cool the inner space of the main body 300 are mounted inside the inner space of the main body 300. Any heater such as a direct heating type heater and an inductive heating type heater can be used as the heater 310. Two types of heaters can be simultaneously mounted to emit heat cooking food.

Also, assuming that a direction in which a user is located is the front direction, the rear end of the top plate 200 located above the main body 300 is located in the front in comparison with the rear surface of the receiving portion 120. That is, the length in the back and forth direction of the top plate 200 is shorter than the length in the back and forth direction of the receiving portion 120, so that a predetermined space is formed between the rear surface of the top plate 200 and the rear end of the receiving portion 120.

The top frame 210 is mounted above the predetermined space formed between the rear surface of the top plate 200 and the rear end of the receiving portion 120 to shield the gap between the top plate 200 and the cabinet 100.

Hereinafter, the top frame 210 is described in more detail.

The top frame 210 includes a portion located to correspond to the top plate 200, and another portion located to correspond to the cabinet 100. In detail, the front end of the top frame 210 is disposed on the top plate 200, and the rear end of the top frame 210 is disposed on the cabinet 100.

The top frame 210 includes a front panel 211 forming a front appearance, a top panel 212 forming an upper appearance, a rear panel forming a rear appearance, and a bottom panel 214 located on the cabinet 100 to provide a plane through which the top frame 210 is supported by the upper surface of the cabinet 100. In detail, the front panel 211 is provided in a rectangular shape long in a horizontal direction, having a predetermined thickness. The top panel 212 is formed on the front end of the front panel 211. The top panel 212 extends to the rear and is formed in a rectangular shape long in a horizontal direction, having a predetermined thickness to form the upper appearance of the top frame 210. The rear panel 213 forming the rear appearance of the top frame 210 is provided at the rear end of the upper panel 212. The rear panel 213 is formed in a rectangular shape long in a horizontal direction, having a predetermined thickness, extends to the rear from the rear end of the upper panel 212, and is inclined downward toward the rear. The bottom panel 214 is provided at the lower end of the rear panel 213. The bottom panel 214 is bent to the front from the lower end of the rear panel 213. The bottom panel 214 is formed in a rectangular shape long in a horizontal direction, having a predetermined thickness. The length in the back and forth direction of the bottom panel 214 is shorter than that of the rear panel 213.

The front end of the bottom panel 214 is located in the rear in comparison with the rear end of the receiving portion 120. That is, the bottom panel 214 extends to the front from the lower end of the rear panel 213. The front end of the bottom panel 214 is located in the rear in comparison with the rear end of the receiving portion 120. A predetermined gap is formed between the rear surface of the top plate 200 and the rear end of the receiving portion 120. The predetermined gap is not narrowed by the bottom panel 214 by the above configuration.

An air outlet 400 is formed in the rear panel 213. The air outlet 400 exhausts fluid flowing upward from the space between the main body 300 and the cabinet 100 to the outside. The air outlet 400 is so cut as to have a rectangular shape long in a horizontal direction, and a predetermined area. Though the outlet 400 formed in the rear panel 213 has the rectangular shape long in the horizontal direction according to the embodiment, it is not limited thereto but a plurality of circular holes having a predetermined diameter can be formed or a plurality of quadrangular holes having a predetermined area can be formed. In other words, the air outlet 400 can be formed in any shape as long as it can exhaust fluid flowing upward from the space between the rear surface of the top plate 200 and the rear end of the receiving portion 120 to the outside.

An air outlet cover 420 selectively opening/closing the air outlet 400 is mounted on the air outlet 400. The air outlet cover 420 can be so formed in a shape corresponding to that of the air outlet 400 as to open/close the entire air outlet 400. When the air outlet 400 is formed in a rectangular shape long in the horizontal direction, the air outlet cover 420 is also formed in the rectangular shape long in the horizontal direction, and the air outlet cover 420 has such an area as to open/close the entire air outlet 400. When the air outlet 400 is formed in the form of the plurality of circular holes having a predetermined diameter, the air outlet 400 is formed to have such an area as to open/close the plurality of holes in their entirety. Of course, the plurality of holes 400 are provided and the air outlet cover 420 covering the air outlets 400 can be provided in the form of a single member, or the number of air outlets covers 420 can be smaller than that of the air outlet 400, so that one or more air outlets 400 can be covered by one of the outlet covers 420.

The air outlet cover 420 is formed to have a predetermined thickness and hinge-coupled to the rear panel 213. The air outlet cover 420 is so mounted as to be opened/closed by wind pressure of fluid passing through the air outlet 400.

Though, preferably, the air outlet cover 420 is hinge-coupled to open/close the air outlet 400 using wind pressure of fluid, a separate open/close device, not a hinge, can be mounted to operate the air outlet cover 420 to selectively open/close the air outlet 400. For example, a motor can be adopted. When a predetermined temperature arrives, the motor can open the air outlet cover 420 or the air outlet cover 420 can be allowed to be open when the fan rotates.

Also, according to the embodiment, fluid that passes between the rear surface of the top plate 200 and the rear end of the receiving portion 120 and flows upward passes through the air outlet 400, changes its passage by a small angle to flow to a right upper direction. Therefore, the passage of the fluid does not change drastically, so that the fluid flows swiftly.

Meanwhile, a first space 510, which is a predetermined space, is formed between the rear surface of the main body 300 and the rear surface of the receiving portion 120. A second space 530 is formed between the upper surface of the cabinet 100 and the top frame 210.

First openings 330 exhausting hot air in the inside of the main body 300 to the first space 510 are formed in the rear surface of the main body 300. The first openings 330 are formed in rectangular shapes long in the horizontal direction, having a predetermined area. Also, the first openings 330 can be provided in the form of a plurality of quadrangular holes having a predetermined area.

Exhaust guides can be formed on the rear surface of the main body 300 to allow fluid passing through the first opening 330 to flow to the second space 530. The exhaust guides are formed at the lower sides of the first openings 330, respectively, to guide the fluid to a right upper direction.

With this configuration, when the pressure of the second space 530 is greater than that of a space on the cabinet 100, that is, the outside space, the air outlet cover 420 is operated by the pressure of the fluid to open the air outlet 400. When the pressure of the second space 530 is lower than that of the outside space, the fluid cannot operate the air outlet cover 420, and thus the air outlet cover 420 does not operate.

When the air outlet cover 420 is operated by the wind pressure of the fluid or a pressure difference between the spaces, water flowing in the vicinity of the cabinet 100 does not flow backward through the air outlet 400 even when the air outlet 400 is opened. That is, since water simultaneously flows in the same direction as the flow direction of the fluid as the fluid flows in high speed, the water does not flow backward through the air outlet 400. Furthermore, when the cooking appliance is not used, the air outlet 400 is shielded, so that introduction of dusts or water in an outside space through the air outlet 400 can be basically prevented.

Figure 8:
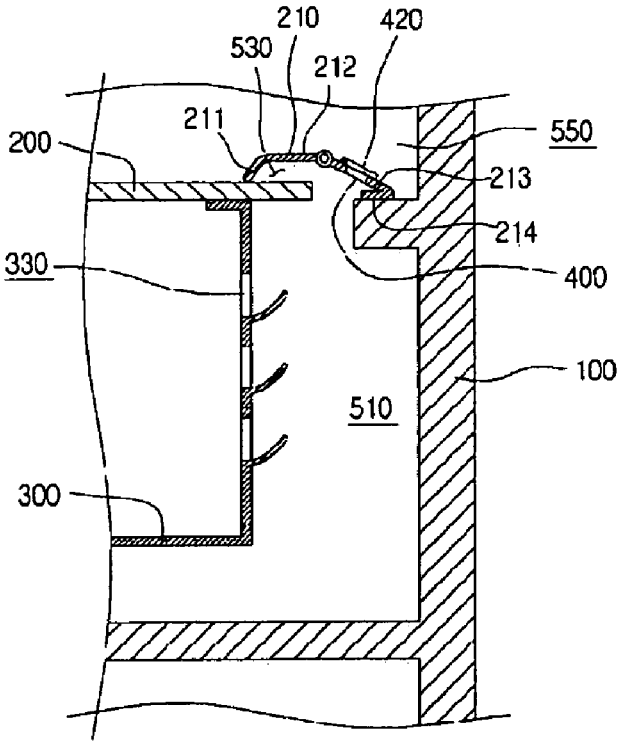
FIG. 8 is a side cross-sectional view of a built-in cooking appliance according to still another embodiment.

FIG. 8 illustrates a top frame of a built-in cooking appliance according to still another embodiment.

Referring to FIG. 8, a front panel 211 has a lower end so located as to contact the upper surface of a top plate 200. The front panel 211 is inclined in a rear direction toward an upper direction. The upper end of the front panel 211 is bent rearward to form an upper panel 212. The upper panel 212 extends rearward from its rear end to form a rear panel 213. The rear panel 213 is so formed as to have a downward slope toward the rear. A bottom panel 214 is formed at the lower end of the rear panel 213. The bottom panel 214 extends to the front. The front end of the bottom panel 214 is located in the rear in comparison with the edges of the rear end of the receiving portion 120. The lower surface of the bottom panel 214 contacts the upper surface of the cabinet 100, or the bottom panel 214 is supported by the upper surface of the cabinet 100 even when the bottom panel 214 does not contact the cabinet 100.

Also, an air outlet 400 and an air outlet cover 420 are provided to the rear panel 213. The air outlet cover 420 selectively opens/closes the air outlet 400 so that fluid flows from the second space 530 to a space on the cabinet 100, that is, an outside space.

According to the top frame 210 having the above-described construction, fluid flowing from the second space 530 to the outside space 550 flows directly to the rear of the top frame 210. The top frame 210 is so configured as to exhaust the fluid in the form of warm air flowing directly to the rear of the top frame 210 in a direction distant from a user, so that discomfort is not generated to the user.

Figure 9:
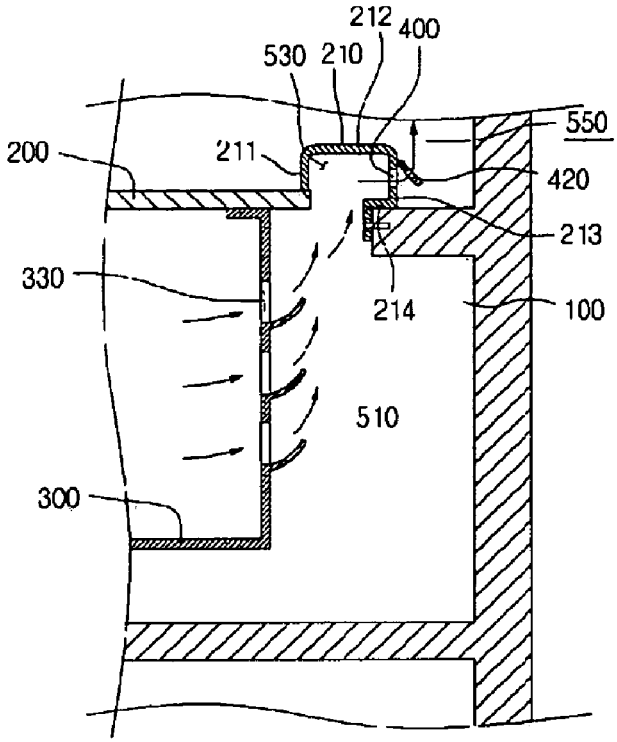
FIG. 9 is a side cross-sectional view of a built-in cooking appliance according to still further another embodiment.

FIG. 9 illustrates a top frame of a built-in cooking appliance according to yet another embodiment.

Referring to FIG. 9, the top frame 210 is fixed to a frame 100 using a screw, so that the top frame 210 can be stably fixed.

Airflow of the built-in cooking appliance is described with reference to FIG. 9.

First, when a user operates the cooking appliance to cook food, temperature of the inside space of a main body 300 is raised to high temperature by heat generated from a heater 310. A fan 320 mounted inside the main body 300 operates to cool the raised temperature of the inside space of the main body 300.

When the fan 320 operates, air is sucked in the axial direction of the fan 320 and discharged in a direction crossing the axis, so that warm air flows to the rear of the inside space of the main body 300. The warm air flowing to the rear of the inside space of the main body 300 flows to a first space 510 through a first opening 330.

When the fan 320 rotates, cool air from the outside is sucked to the inside space of the main body 300 through an air inlet, and the cool air from the outside cools the inside of the main body 300 while flowing the inside space of the main body 300.

The warm air flowing to the first space 510 is guided by an exhaust guide to a second space 530. Warm air flowing to the second space 530 passes through an air outlet 400. The warm air flows upward through convection of air even when the exhaust guide is not formed.

The warm air passing through the air outlet 400 rotates an air outlet cover 420 shielding the air outlet 400 using wind pressure of the warm air or high pressure generated from the second space 530.

When the air outlet cover 420 rotates, the warm air located in the second space 530 passes through the air outlet 400 to flow to the outside space. When the warm air is exhausted to the outside space and the pressure of the second space 530 is equal to that of the outside space, or the wind pressure of the warm air reduces, the air outlet cover 420 shields the air outlet 400 again.

When the air outlet cover 420 shields the air outlet 400, the pressure of the second space 530 is raised or the wind pressure of the warm air is raised by warm air flowing in the first space 510.

While these processes are repeatedly performed, warm air formed in the inside space of the main body 300 is consistently exhausted to the outside space to cool the temperature of the inside space of the main body 300. Also, the rotational motion of the fan 320 generates airflow to cool the entire cooking appliance.

Fluid adjacent to the cooking appliance is described according to an embodiment.

First, since the cooking appliance is mounted adjacent to a kitchen sink, it is installed in a place where water is frequency used. It is preferable that water is not introduced to the inner space of the main body 300 even when the cooking appliance is installed in a place where water is frequency used. For this purpose, the bottom surface of the top plate 200 and a contact surface of a portion of the top plate 200 seated in the receiving portion 120 are sealed by a predetermined sealing material to contact each other in the front and both sides of the top plate 200.

Therefore, fluid from the outside space is not introduced to the inside space of the main body 300, and a limitation due to the fluid from the outside space is generated by the top frame 210 located in the rear of the top plate 200. In detail, the limitation due to the fluid from the outside space is generated by the space between the rear end of the top frame 210 located above the cabinet 100 and the rear end of the receiving portion 120.

The air outlet 400 formed in the top frame 210 is provided at a position higher than the upper surface of the cabinet 100 by a predetermined level. The air outlet 400 allows warm air generated from the inside space of the main body 300 to be exhausted to the outside space after it is exhausted through the first openings 330. As the air outlet 400 is shielded by the air outlet cover 420, water introduced to the inside space of the main body 300 through the air outlet 400 is basically blocked.

Excessive water introduced through the air outlet 400 even under this configuration falls down to the first space 510. The water falling down to the first space 510 can be discharged to the outside space of the cabinet 100 through a separate water outlet formed in the inside space of the cabinet 100 located below the receiving portion 120, which is the same as in the previous embodiment.

Also, a skirt having a predetermined length and extending downward can be formed at the air outlet 400 formed in the top frame 210 to allow water falling down through the first space 510 to swiftly flow to the water outlet. In this case, since water falls down guided by the skirt, it is possible to basically remove possibility that the water is introduced to the inside space of the main body 300.

The water outlet allows water formed on the lower surface of the receiving portion 120 to be collected and drained to the outside space in the case where the lower surface of the receiving portion 120 is closed. For another case, in the case where the lower surface of the receiving portion 120 is not closed but open, a water collecting device can be provided to a predetermined position below the receiving portion 120 to collect water falling down from above the cooking appliance and drain the water to the outside space.

Also, though the top frame 210 is installed along the upper edges of the top plate 200, it is not limited thereto but can be installed at the front edges and both side edges of the top plate 200. Also, each top frame 210 can be installed while it is disposed on each edge.

Figure 10:
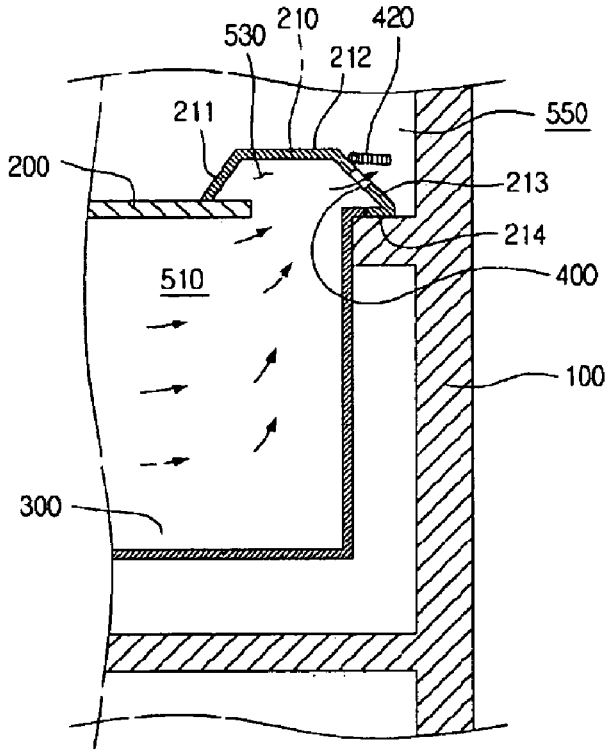
FIG. 10 is a side cross-sectional view of a built-in cooking appliance according to yet further another embodiment.

FIG. 10 is a view of a main body in a built-in cooking appliance according to yet further another embodiment.

Referring to FIG. 10, the rear surface of the main body 300 is located in the further rear than the rear surface of the top plate 200. According to the built-in cooking appliance having the above construction, a separate first opening 330 is not formed in the rear surface of the main body 300, and warm air in the inside space of the main body 300 is guided by the inner sides of the main body 300 to flow upward. The warm air flowing upward flows to a second space 530.

The warm air flowing to the second space 530 rotates an air outlet cover 420 using the wind pressure of the warm air or the pressure of the main body 300 and is exhausted to the outside.

This embodiment can be realized because it is guaranteed that the air outlet cover 420 prevents water from the outside from being introduced into the main body 300.

It would be obvious to provide another embodiment by applying one of elements included in the embodiments to other embodiment. Therefore, such an embodiment cannot be described in its entirety. However, it is obvious that a better effect can be obtained for a specific use through an embodiment not described in its entirety.

Industrial Applicability

According to the present disclosure, the inside of the cooking appliance is effectively cooled and the inside can be waterproofed without protruding the top plate above the cabinet. Therefore, cooling efficiency, stability in using, convenience in cleaning, esthetic feeling, and reliability of a product can be improved.

The invention claimed is:

1. A built-in cooking appliance comprising:

a top plate;

a main body below the top plate, inside which at least a heating unit is disposed, the main body having at least an air hole;

a fan forming a cooling passage inside the main body;

a cabinet on which the top plate is installed;

a gap portion defining at least a portion of the cooling passage, the gap portion being formed by at least an edge on one side of the top plate and the cabinet separated from each other; and a top frame covering the gap portion and having an air outlet to guide air discharged through the gap portion to an outside, wherein the air discharged from the air hole of the main body flows to the air outlet, after flowing through a space defined between the main body and the cabinet.

2. The built-in cooking appliance according to claim 1, wherein an upper surface of the top plate is lower than an upper surface of the cabinet.

3. The built-in cooking appliance according to claim 1, wherein a contact portion between the top frame and the top plate is at least partially open.

4. The built-in cooking appliance according to claim 1, wherein a first opening is formed in a front side of the top frame and is open to a front of the top frame, the first opening comprises:

a first fluid flow passage through which warm air inside the main body is discharged to an outside; and a second fluid flow passage through which fluid on the top plate is discharged below the top plate.

5. The built-in cooking appliance according to claim 4, wherein a second opening is formed in the top frame to discharge air in a direction different from a direction of the first opening.

6. The built-in cooking appliance according to claim 4, wherein the first opening is a gap between a lower end of the top frame and an upper surface of the top plate.

7. The built-in cooking appliance according to claim 1, further comprising:

a support on an edge where the top frame is disposed, the support connecting the main body to the cabinet; and a support through hole in the support to allow the air discharged from the air hole to be discharged to the top frame.

8. The built-in cooking appliance according to claim 7, further comprising a guide guiding the air discharged from the air hole to the support through hole.

9. The built-in cooking appliance according to claim 1, further comprising:

an air outlet cover selectively covering the air outlet.

10. The built-in cooking appliance according to claim 9, wherein the air outlet is provided to a rear portion of top frame.

11. The built-in cooking appliance according to claim 9, wherein the air outlet cover is hinge-coupled to the top frame.

12. The built-in cooking appliance according to claim 9, where the air outlet cover opens the air outlet during an operation of the fan.

13. The built-in cooking appliance according to claim 1, wherein an upper surface of the top plate is higher than an upper surface of the cabinet.

14. An installation apparatus of a built-in cooking appliance, the installation apparatus comprising:

a top plate;

a main body below the top plate, in which a plurality of parts are mounted, having at least an air hole;

a cabinet providing a space receiving the main body;

a top frame placed between the top plate and the cabinet;

an air outlet in the top frame, the air outlet allowing fluid inside the main body to be discharged outside the cabinet; and an air outlet cover opening/closing the air outlet, wherein cabinet comprises a seat portion, the top plate is directly seated on the seat portion, and wherein air discharged from the air hole of the main body flows to the air outlet, after flowing through a space defined between the main body and the cabinet.

15. The installation apparatus according to claim 14, wherein the air outlet cover is operated by wind pressure of fluid passing through the air outlet.

16. The installation apparatus according to claim 14, wherein the air outlet cover operates in cooperation with an operation of a fan inside the main body.

17. The installation apparatus according to claim 14, wherein an upper surface of the top plate is not lower than an upper surface of the cabinet.

18. A built-in cooking appliance comprising:

a top plate;

a main body below the top plate, inside which at least a heating unit is disposed;

a cabinet on which the top plate is installed;

a support supporting the top plate against the cabinet; and a top frame covering at least one edge of the top plate, an upper surface of the top plate being lower than an upper surface of the cabinet, wherein a contact portion between the top frame and the top plate is at least partially open.

19. The built-in cooking appliance according to claim 18, wherein air is discharged in both directions below the top frame.

20. An installation apparatus of a built-in cooking appliance, the installation apparatus comprising:

a top plate;

a main body below the top plate, inside which at least a heating unit is disposed, having at least an air hole;

a fan forming a cooling passage inside the main body;

a cabinet on which the top plate is installed;

a gap portion defining at least a portion of the cooling passage, the gap portion being formed by at least an edge on one side of the top plate and the cabinet separated from each other;

a top frame covering the gap portion; and an air outlet in the top frame to discharge air to an outside, wherein the air discharged from the air hole of the main body flows to the air outlet, after flowing through a space defined between the main body and the cabinet.

* * * * *